United States Patent [19]

Theilen

[11] 4,341,477

[45] Jul. 27, 1982

[54] PAPER HANDLING ASSEMBLY FOR TYPEWRITERS OR LIKE MACHINES

[75] Inventor: Rolf Theilen, Furth, Fed. Rep. of Germany

[73] Assignee: Triumph-Adler A.G. für Büro-und Informationstechnik, Nuremberg, Fed. Rep. of Germany

[21] Appl. No.: 204,212

[22] Filed: Nov. 5, 1980

[30] Foreign Application Priority Data

Mar. 6, 1980 [DE] Fed. Rep. of Germany ..... 3008540

[51] Int. Cl.[3] ..... B41J 11/20; B41J 13/036

[52] U.S. Cl. ..... 400/56; 400/637.2; 400/639.1

[58] Field of Search ..... 400/637, 637.1, 637.2, 400/639.1, 639.2, 56, 57, 58, 55, 59, 60, 649, 653, 648

[56] References Cited

U.S. PATENT DOCUMENTS

| | | | |
|---|---|---|---|
| 693,033 | 2/1902 | Knapp | 400/338 |
| 1,530,916 | 3/1925 | Smith | 400/649 X |
| 2,002,361 | 5/1935 | Christian | 400/639.1 |
| 2,337,583 | 12/1943 | Anderson | 400/648 X |
| 2,566,963 | 9/1951 | Ritz | 400/57 |

*Primary Examiner*—Edgar S. Burr
*Assistant Examiner*—Charles Pearson
*Attorney, Agent, or Firm*—Joseph R. Spalla

[57] ABSTRACT

A paper handling assembly supporting a platen, a paper bail adjustably mounted for movement relative to said platen and a paper guide trough adjustably mounted for movement relative to said platen. The assembly includes a common shaft which mounts a first paper pack thickness adjusting lever operative to rotate said shaft to effect movement of the entire paper handling assembly relative to a frame to adjust the printing gap, rotatably supports a second paper bail adjusting lever operative to adjustably move said paper bail, and rotatably supports a third paper trough adjusting lever operative to adjustably move said paper trough.

3 Claims, 2 Drawing Figures

PAPER HANDLING ASSEMBLY FOR TYPEWRITERS OR LIKE MACHINES

Figure 1:
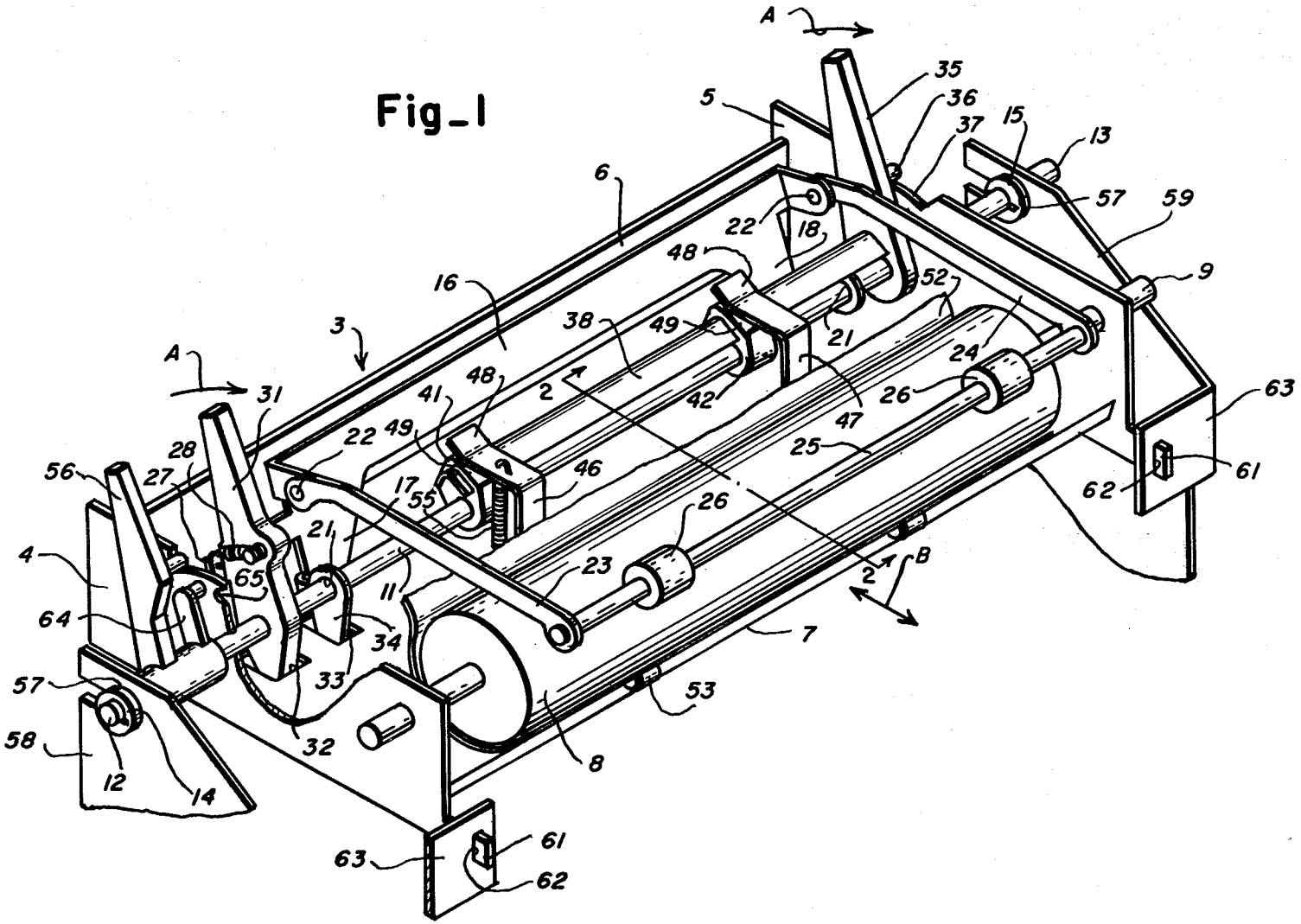

This invention relates to a paper handling assembly bodily movable as a unit to adjust a printing gap; more particularly it relates to such a paper handling assembly having a common shaft mounting and supporting levers to effect adjustment of said printing gap, a paper bail and a paper guide trough.

Generally typewriters or like machines have paper handling assemblies including a platen which is adjustable relative to a printing element to vary the printing gap for different paper pack thicknesses, a liftable paper bail adapted to clamp paper about the platen and a releasable paper trough adapted to permit alignment of paper before clamping same.

All of these functional elements are provided with levers to effect the necessary adjustments. Such levers are generally separately pivoted on separate bearings in the side frames of the paper handling assembly. This necessitates that numerous holes be drilled, bolts riveted, and adjusting levers attached and secured in place by suitable means all of which increases the cost of manufacture and assembly.

In accordance with the invention there is provided a paper handling assembly having a single assembly supported shaft on which adjusting levers for controlling all the paper handling functions through associate parts can be easily mounted and located to achieve economy of manufacture and assembly. An object of the invention is to provide a paper handling assembly wherein the various adjusting levers are supported on a common assembly supported shaft.

Another object of the invention is in the provision of a paper handling assembly which can be easily manufactured and assembled.

Figure 2:
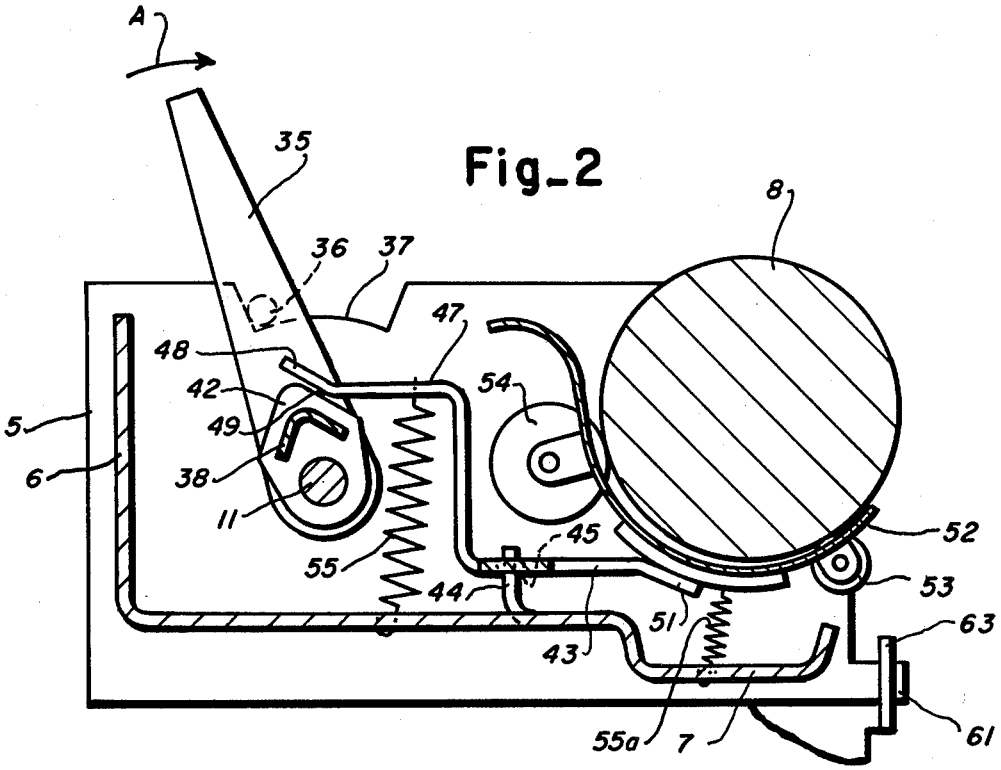

Other objects, features and advantages of the present invention will become known to those skilled in the art from a reading of the following detailed description when taken in conjunction with the accompanying drawing wherein like reference numerals designate like or corresponding parts throughout the several views thereof, and wherein:

FIG. 1 is a perspective view of a paper handling assembly in accordance with the invention; and FIG. 2 is a cross sectional view taken along lines 2—2 of FIG. 1.

Referring now to the drawing there is shown in FIG. 1 a paper handling assembly, generally designated by reference numeral 3, having spaced left and right side walls 4 and 5 connected by a rear wall 6 and a bottom wall 7. A platen 8 mounted on a shaft 9 is rotatably supported by and between side walls 4 and 5. Also rotatably supported by and between side walls 4 and 5 is a control shaft 11 whose left and right ends 12 and 13 extend outwardly of the left and right side walls 4 and 5 and non rotatably mount eccentric bosses 14 and 15 respectively.

Inwardly of the side walls 4 and 5 and adjacent the rear wall 6 is a cross piece 16 having depending legs 17 and 18 which are bent forwardly and are provided with holes 21 through which the control shaft 11 extends and rotatably supports the cross piece 16. The ends of the cross piece 16 are also bent forwardly and pivotably support as at 22 the arms 23 and 24 of a paper bail 25 carrying rollers 26 engagable with the platen 8. The left depending leg 17 of cross piece 16 is also formed with an extension 27 which is connected by a motion transmitting spring 28 to a paper bail control lever 31 rotatably mounted on the control shaft 11 inwardly of the left side wall 4.

As shown in FIG. 1 the bottom wall 7 of the assembly 3 is provided with rectangular locating openings 32, 33 into which the lower end of the lever 31, and a projection 34 on the bent out depending leg 17 respectively extend. The front and rear edges of the openings 32, 33 limit the pivotal movement of the lever 31 and the cross piece 16.

Inwardly of the right side wall 5 the control shaft 11 further pivotally supports a paper through release lever 35 whose pivotal movement relative to the right side wall 5 is limited by a rightwardly extending pin 36 in cooperation with a cutout 37 in the right side wall 5. Secured to the paper trough release lever 35 is a cross bar 38 to which spaced cams 41, 42 pivotably mounted on the control shaft 11 are secured.

With reference to FIG. 1, and to FIG. 2 in particular, there is shown a generally horizontal cross piece 43 which is pivotally supported as by lugs 44 formed by cut out and bent up portions of the bottom wall 7 extending into openings 45 in the cross piece 43. The cross piece 43 is formed with upwardly and rearwardly directed extensions 46 and 47 whose ends 48 overlie flat faces 49 on the cams 41, 42. The cross piece 43 also has forwardly extending fingers 51 formed so as to underlie and to support a curved paper insert and guide through 52 which follows the curvature of the platen 8 and which supports front and rear feed rollers 53, 54. The cross piece 43 is biased by a spring 55 which, as viewed in FIG. 2, urges the cross piece 43 counterclockwise with its fingers 51 urging the paper guide through 52 toward the platen 8 and its feed rools 53, 54 in driving engagement with the platen 8 against the bias of a spring 55*a* urging the paper guide trough 52 away from the platen 8.

To separate the paper trough feed rolls 53, 54 from engagement with the platen 8 to enable inserted paper to be squared with a writing line, the release lever 35 will be rocked forwardly or clockwise in the direction of arrow A, thus rotating cams 41, 42 which engage and drive extensions 46, 47, thus to drive cross piece 43 clockwise and its fingers 51 away from the paper guide through 52 which under urging of its spring 55*a* follows the movement of the cross piece 43.

Further as shown in FIG. 1, a printing gap adjusting lever 56 is connected to the eccentric boss 14, outwardly of the left side wall 4. When the assembly 3 is mounted on a machine the eccentrics 14, 15 are mounted in circular openings 57 of left and right machine frame walls 58, 59 whereby rotation of the lever 56 and control shaft 11 will move the assembly 3 relative to the machine frame. The assembly 3 is guided for movement relative to the machine frame as by projections 61 extending from side walls 4 and 5 into openings 62 in bent in portions 63 of the left and right frame walls 58, 59.

In view of the above when paper bail lever 31 is rotated in the direction of arrow A spring 28 pulls cross piece 16 forwardly about control shaft 11 to the limit of movement of projection 34 in bottom wall opening 33. This movement lifts paper bail 25 away from the platen 7 to allow paper to be placed about the platen 7. To clamp the paper bail 25, the lever 31 is rotated opposite to direction A.

When paper inserted in the assembly is to be aligned or squared, the adjusting lever 35 is also rotated in direction A which, through cross bar 38 rotates the cams 41, 42 which act on extensions 46, 47 to rock the cross piece 43, thereby to allow movement of the paper trough 52, and feed rollers 53, 54 supported thereby, away from the platen 8.

When the platen 8 is to be adjusted to the thickness of paper inserted, lever 56 is also turned forwardly or rearwardly. This rotates the eccentrics 14, 15 rotatably supported in machine frame side walls 58, 59 which results in movement of the assembly 3 relative thereto either forwardly or rearwardly as indicated by double arrow B. As shown in the drawing and described in said copending application, the eccentric 14 carries an arm 64 whose end is detentably engagable with angularly located detent holes 65 in the left side wall 4.

In accordance with the invention the provision of a common shaft 11 to support all of the paper handling assembly controls enables easy preassembly of the various parts and concomitant cost savings.

The paper handling assembly 3 can be adapted for mounting on a machine having a carriage movable relative to a fixed printing point as well as to a movable printing point machine as described. In a movable paper handling assembly the frame side walls 58, 59 would be the side walls of the movable carriage.

The invention claimed is:

1. In combination, a frame and a paper handling assembly adapted to be mounted on said frame, said paper handling assembly comprising side walls and a bottom wall, a platen rotatably supported between said side walls, a paper trough having feed rolls, means supporting said paper trough with its feed rolls engaging said platen, a common shaft rotatably supported on said side walls, paper bail means rotatably supported on said common shaft, eccentrics secured to the ends of said shaft outwardly of said side walls adapted to be rotatably mounted in said frame, first lever means connected to rotate said eccentrics for moving said assembly relative to said frame, second lever means rotatably mounted on said common shaft an coupled to pivotally move said paper bail means, and third lever means rotatably mounted on said common shaft and coupled to move said paper trough supporting means to separate said paper trough feed rolls from engagement with said platen.

2. The combination recited in claim 1, said assembly bottom wall having openings to guide and limit movement of said second lever means.

3. The combination recited in claim 1, including cams rotatably mounted on said common shaft and rotated by said third lever means, and said means supporting said paper trough being operative by said cams.

* * * * *